United States Patent [19]

Esterline

[11] 4,022,156

[45] May 10, 1977

[54] WORK HOLDING DEVICE

[75] Inventor: Theodore C. Esterline, Erie, Pa.

[73] Assignee: Mafix, Inc., Erie, Pa.

[22] Filed: Sept. 17, 1975

[21] Appl. No.: 614,171

[52] U.S. Cl. ..... 118/504; 101/126

[51] Int. Cl.[2] ..... B05C 15/00; B05C 17/08; B05C 13/00

[58] Field of Search ..... 118/504, 505, 301; 354/317, 325; 427/282; 101/126

[56] References Cited

UNITED STATES PATENTS

| | | | |
|---|---|---|---|
| 2,125,457 | 8/1938 | Merritt | 427/282 X |
| 2,991,711 | 7/1961 | Ehrhard et al. | 101/126 |
| 3,098,431 | 7/1963 | Weaver | 101/126 |
| 3,380,434 | 4/1968 | Faber | 118/504 X |
| 3,741,154 | 6/1973 | Szczepanski | 118/504 X |

*Primary Examiner*—James Kee Chi

[57] ABSTRACT

A work holder comprising a fixed frame, a movable supported frame supported on upwardly movable columns urged upwardly by springs and a work holder frame hinged to the movable support and hydraulic cylinder connected to the fixed frame and to the work support frame so that when the hydraulic cylinder extends, the springs first move the work support and the work holder frame up together away from the fixed frame and then the hydraulic cylinder causes the work holder frame to swing upwardly away from the support frame.

4 Claims, 5 Drawing Figures

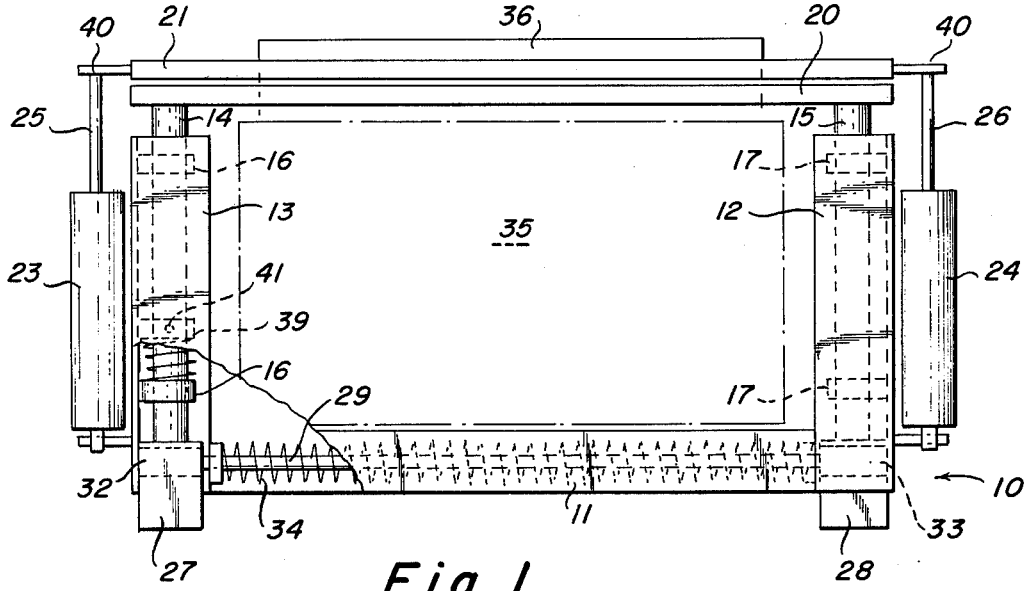
Fig. 1
Fig. 2
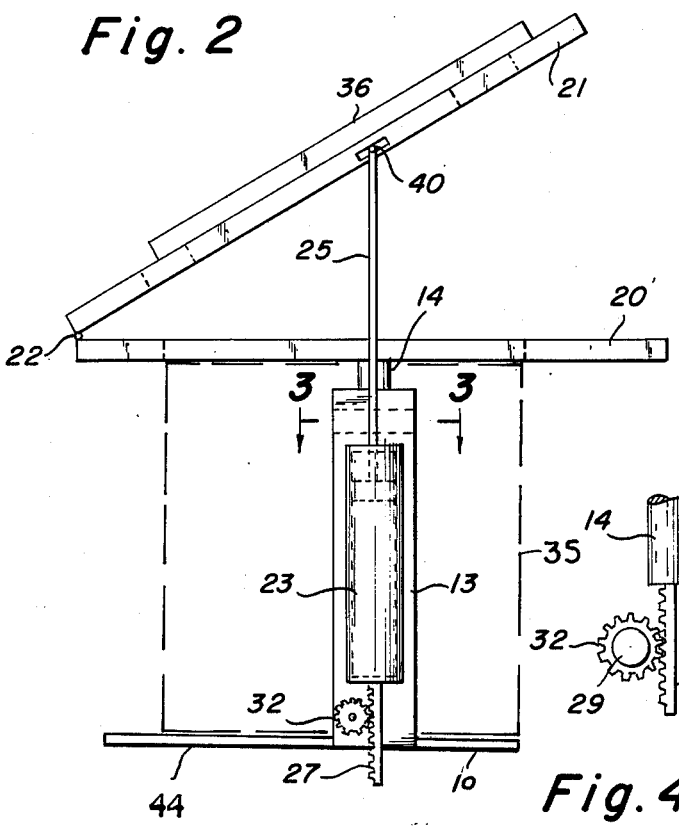
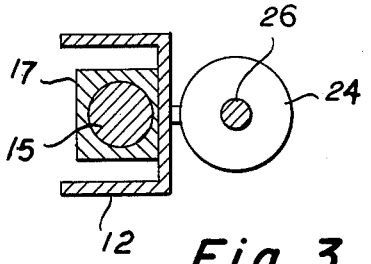
Fig. 3
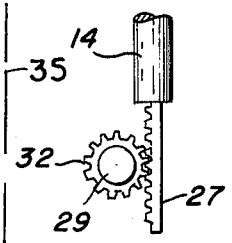
Fig. 4
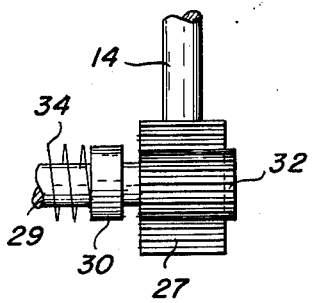
Fig. 5

WORK HOLDING DEVICE

OBJECT OF THE INVENTION

It is an object of the invention to provide an improved work holder and support.

Another object of the invention is to provide a work holder and support that is simple in construction, economical to manufacture, and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions, and minor details of construction without departing from the spirit or sacrificing any of the advantages of the invention.

GENERAL DESCRIPTION OF THE DRAWINGS

FIG. 1 shows a side view of the work holder according to the invention.

FIG. 2 shows an end view of the work holder support.

FIG. 3 shows a cross sectional view taken on line 3 —3 of FIG. 2.

FIG. 4 shows a partial end view of the spur gear and rack arrangement.

FIG. 5 shows a front view of the spur gear and arrangement.

DETAILED DESCRIPTION OF THE DRAWINGS

Now with more particular reference to the drawing. The machine shown shows a fixed frame 10 having a horizontal frame member 11 and two spaced vertically extending members 12 and 13 fixed to the ends of horizontal frame member 11. The horizontally spaced vertically extending movable columns 14 and 15 are received in lugs 16 and 17 and slide upwardly and downwardly therein. The lugs 16 and 17 are welded to the vertical frame members 12 and 13. The movable work holder support frame 20 is attached to the movable columns 14 and 15 and moves upwardly and downwardly thereon urged by the piston rods 25 and 26 in cylinders 23 and 24. The mask support frame 20 is supported on the upper ends of the columns 14 and 15. The mask holder frame 21 is hinged at 22 to mask support frame and can swing upwardly and downwardly relative to it. The spaced hydraulic cylinders 23 and 24 are fixed to the fixed frame members 12 and 13 and the cylinders have piston rods 25 and 26 that are pivoted to the lugs 40 on the work holder frame 21.

Column 14 has a collar 39 attached thereto by pin 41 and a helical compression spring 42 is received on column 14 between collar 40 and lug 16. Spring 42 urges columns 14 and 15 and frame 21 to move upwardly when no air under compression is forced into the cylinders 23 and 24. The frame 21 is thus moved away from frame 20 and away from the article 35 when pistons in cylinder 23 and 24 first move upward.

Racks 27 and 28 are fixed to the lower ends of columns 14 and 15 and move upwardly and downwardly thereon. These racks, engage the spur gears 32 and 33 on the ends of the shaft 29. The shaft 29 is supported in bearing means 30 on its end. Bearings 30 are fixed to the fixed frame. A helical spring 34 is pinned to the shaft 29 at its midpoint and the ends are pivoted to the spur gears 32 and 33 urging spur gears to rotate to move the columns 14 and 15 up against the force of piston rods 25 and 26 which hold the frame down.

Thus, when it is desired to open frame 21, the piston rods 25 and 26 are extended from cylinders 23 and 24. As rods 25 and 26 first move they allow the columns 14 and 15 to move upwardly thereby moving the mask 36 away from frame 30 and away from the article 35 as the piston rods 25 and 26 continue to move upward and the columns 14 and 15 move upward to bring a stop against lug 16 on the mask support frame 10. The fixed frame can then move no further upward and the swingable frame 21 then swings upwardly to the position shown in full lines of FIG. 2. Thus, an article to be spray painted indicated at 35, can be placed into the fixture, for example, from the fixture's open front. A paint mask 36 having suitable openings to allow the paint to pass through onto the article indicated at 35 will be supported on mask support frame 20. When the article 35 is in place, the cylinders can be energized to move the piston rods 25, and 26 downward thereby swinging the frame 21 into engagement with work holder 20 and then pulling both frame 20 and 21 straight downward in a linear path beginning the mask 36 into engagement with the article 35.

The foregoing specification sets forth the invention in its preferred practical forms but the structure shown is capable of modification within a range of equivalents without departing from the invention which is to be understood is broadly novel as is commensurate with appended claims.

The embodiment of the invention in which an exclusive property or privilege is claimed are defined as follows:

1. A work support comprising a fixed frame comprising, a horizontal frame member and vertically extending frame members fixed to said horizontal frame member extending upwardly therefrom, horizontally-spaced, vertically extending movable columns, vertically-spaced lugs attached to said vertically-extending frame members and bearing means on said lugs slidably receiving said movable columns, a movable work support frame attached to said columns and movable upwardly and downwardly therewith, and means supported on said fixed frame urging said movable columns upwardly, a mask holder hinged to said work support frame at one edge and swingable upwardly and downwardly relative thereto, spaced hydraulic cylinders supported on said vertically extending frame members, said cylinders each having a piston rod connected to said mask holder whereby said movable work support frame and said mask holder are moved upwardly a first distance away from said work, and then said mask support frame is swung from said movable frame.

2. The fixture recited in claim 1 wherein a rack is fixed to the lower end of each vertically movable column and a shaft is rotatably supported on said fixed frame, bearing means suppporting said shaft on said fixed frame, a spur gear on each end of said shaft, said spur gears engaging said racks, a helical spring on said shaft urging said spur gears to rotate urging said vertically extending frame members upward and stop means limiting upward movement of said vertically extending columns.

3. The work support recited in claim 1 wherein said work support frame supports a painting mask, and means is provided on said fixed frame for supporting an article to be painted.

4. The workholder recited in claim 1 wherein a space is provided between said vertically extending frame members, said horizontally extending members and said mask support frame, said space being adapted to receive an article to be painted, a mask supported on said mask support, said mask having openings adapted to allow paint to pass therethrough, said mask being adapted to overlie said article whereby paint can be sprayed on said mask and deposited on selected areas on said article.

* * * * *